US005975523A

United States Patent [19]

Suzuki

[11] Patent Number: 5,975,523

[45] Date of Patent: Nov. 2, 1999

[54] SHEET CONVEYER AND PRINTER FITTED THEREWITH

[75] Inventor: Hiroshi Suzuki, Anjou, Japan

[73] Assignee: Brother Kogyo Kabushiki Kaisha, Nagoya, Japan

[21] Appl. No.: 08/942,203

[22] Filed: Oct. 1, 1997

[30] Foreign Application Priority Data

Oct. 15, 1996 [JP] Japan ..... 8-272094

[51] Int. Cl.[6] ..... B65H 9/04

[52] U.S. Cl. ..... 271/242; 271/264; 271/274

[58] Field of Search ..... 271/272, 273, 271/274, 264, 242; 400/636, 637, 639, 642

[56] References Cited

U.S. PATENT DOCUMENTS

| | | | |
|---|---|---|---|
| 4,071,233 | 1/1978 | Morton | 271/264 |
| 4,353,274 | 10/1982 | Shimizu | 271/273 |
| 5,282,614 | 2/1994 | Kalisiak | 271/272 |
| 5,324,019 | 6/1994 | Chang et al. | 271/272 |
| 5,324,124 | 6/1994 | Bayerie et al. | 400/636 |
| 5,580,042 | 12/1996 | Taniguro et al. | 271/274 |
| 5,692,744 | 12/1997 | Funato | 271/272 |
| 5,800,076 | 9/1998 | Umeda | 271/274 |

FOREIGN PATENT DOCUMENTS

| | | | |
|---|---|---|---|
| 61-197344A | 9/1986 | Japan | 271/273 |
| 403061240 | 3/1991 | Japan | 271/272 |
| A-8-30814 | 2/1996 | Japan . | |

*Primary Examiner*—H. Grant Skaggs
*Attorney, Agent, or Firm*—Oliff & Berridge, PLC

[57] ABSTRACT

A sheet conveyer includes a feed roller, a pressure roller, a first guide and a second guide. The guides define a traveling passage between them for a sheet of paper to be sent to the nip between the rollers. The guides are positioned in such a manner that the passage narrows toward the nip. Even if a sheet of paper is wavy widthwise, it is flattened when sent to the nip. At least a front end portion of the second guide is made of material which can elastically deform toward the nip. The front end portion extends to a position very near to the nip. Even if the direction in which a sheet of paper is conveyed changes at a sharp angle just before the sheet reaches the nip, the elastic portion makes the sheet turn or bend gently, preventing it from turning or bending sharply.

17 Claims, 8 Drawing Sheets

SHEET CONVEYER AND PRINTER FITTED THEREWITH

BACKGROUND OF THE INVENTION

1. Field of the Invention

The present invention relates to a sheet conveyer and a printer fitted with a sheet conveyer.

2. Description of the Related Art

The assignee's Japanese Patent Application No. 8-30814 discloses an ink jet printer, which includes a feed roller and pressure rollers in compressive contact with the feed roller. The pressure rollers are supported by holders. A sheet passage is formed between each of the holders and a passage wall positioned upstream from the feed roller. The passage wall inclines toward the holders. Whichever of the passage wall and the holders a sheet of paper is fed along, the front end of the sheet is guided or led finally along the holders securely to the lines of contact each between the feed roller and one of the pressure rollers.

If a sheet of paper is fed along the passage wall, and when the front end of the sheet is sent between the feed roller and the pressure rollers, the sheet turns or bends sharply at the front end of the wall toward the lines of contact between the rollers. This causes high resistance to the feeding. In particular, an envelope, a post card or another paper sheet of higher rigidity does not easily bend, and therefore the resistance to it is higher, hindering the feeding. Therefore, the front end of the passage wall might be spaced as away as possible from the feed roller so that a sheet of paper bends gently at the wall end. By the way, as shown in FIG. 8 of the drawings accompanying this specification, it is not avoidable that the front end of a sheet S being fed is largely wavy up (S2) and down (S1) over the width of the sheet. If the passage wall and the feed roller were spaced wide from each other, the valley/s of the sheet wave might meet the cylindrical surface of the feed roller nearly radially of the roller. As a result, the sheet might be damaged. In particular, the damage is serious if the wave valley/s meets/meet the feed roller turning reversely (in the direction opposite to the feeding direction) to register the sheet end. It is therefore not possible to make the space between the passage wall and the feed roller very wide.

SUMMARY OF THE INVENTION

It is an object of the present invention to guide or lead a sheet of paper securely to the lines of contact between the feed roller and the pressure rollers, and to reduce the resistance to the sheet being fed. It is another object of the invention to provide a sheet conveyer which can prevent a sheet of paper to be conveyed from reaching, in widthwise wavy condition, the peripheral surface of the feed roller. It is a further object of the invention to provide a recorder including such a conveyer.

It is still another object of the invention to provide a sheet conveyer which can prevent a sheet of paper conveyed from the sheet guide from breaking by turning or bending sharply while the sheet is conveyed between the feed roller and the pressure rollers. It is a further object of the invention to provide a recorder including such a conveyer.

In accordance with a first aspect of the invention, a sheet conveyer is provided, which includes a feed roller and a pressure roller. The rollers are in compressive contact with each other, and cooperate to feed a sheet of paper between them. The conveyer also includes a first guide and a second guide, which define a traveling passage between them for a sheet of paper to be sent to the nip between the rollers. The guides are positioned in such a manner that the passage narrows toward the nip. At least a front end portion of at least one of the guides is made of material which can elastically deform toward the nip.

The first guide (first passage wall) and the second guide (second passage wall) define the traveling passage between them for a sheet of paper to be sent to the nip between the rollers. The guides are positioned in such a manner that the passage narrows toward the nip. Accordingly, even if the sheet is wavy widthwise, it is flattened when sent to the nip. This solves the problem in the prior art that a widthwise wavy sheet may be damaged by meeting the feed roller. At least the front end portion of at least one of the guides is made of material which can elastically deform toward the nip. This portion can therefore extend to a position very near the nip. In particular, the sheet conveyer structure disclosed in Japanese Patent Application No. 8-30814 has a problem that a sheet of paper turns or bends sharply when leaving the guide adjacent to the feed roller (the guide for supporting the lower side of a sheet) and moving toward the nips between the feed roller and the pressure rollers. In the present invention, at least the front end portion of at least one of the guides is made of elastic material. The elastic portion allows a sheet of paper moving along the traveling passage to turn or bend gently, preventing the sheet from turning or bending sharply, even if the sheet is not directed to the nip between the rollers, that is to say, even if the direction of sheet conveyance changes at a sharp angle just before the sheet reaches the nip. This prevents the sheet from being damaged and/or the feeding from being hindered by the sheet turning or bending sharply.

The first and second guides may be positioned in such a manner as to guide the upper and lower sides, respectively, of a sheet of paper being sent to the nip. The guides and the nip may be positioned relative to each other in such a manner that a production (an extension line) from the second guide intersects the first guide on the upstream side from the nip. Such positional relationships between the guides and the nip make a sheet of paper guided finally along the first guide to the nip, whichever guide the sheet is sent along.

The second guide may be positioned relative to the nip in such a manner that the plane between the front end of the second guide and the nip extends at an obtuse angle with the guide surface of the second guide.

The first guide may be an elastic member, and adapted for contact with the feed roller on the upstream side from the nip. The pressure roller might be replaced by a plurality of pressure rollers, which are arranged at intervals along the axis of the feed roller. The first guide might be replaced by a plurality of first guides, each of which extends between adjacent two of the pressure rollers from the upstream sides of the nips to the downstream sides of the nips. The nips each between the feed roller and one of the first guides can register a sheet of paper. While a sheet of paper is registered, the feed roller is stopping or turning reversely (in the direction opposite to the feeding direction). Therefore, the front end of the sheet is not sent to the nips between the feed and pressure rollers, but the sheet bends or warps in the feeding direction. The bend or warp registers the front edge of the sheet. In an embodiment of the invention, the second guide includes a front end portion made of elastic material. The elastic end portion of the guide, too, deforms in accordance with the bend or warp of a sheet of paper, and in particular of a thick sheet, being registered. This configuration of the second guide secures sufficient bending or warping space for full registration.

In accordance with a second aspect of the invention, a recorder is provided, which includes a feed roller and a pressure roller. The rollers are in compressive contact with each other, and cooperate to feed a sheet of paper between them. The recorder also includes a first guide and a second guide, which define a traveling passage between them for a sheet of paper to be sent to the nip between the rollers. The guides are positioned in such a manner that the passage narrows toward the nip. At least a front end portion of at least one of the guides is made of material which can elastically deform toward the nip. The recorder further includes a recording head positioned downstream from the nip.

The recorder prevents hindrance to the feeding, which was caused conventionally by a sharp bend or turning and/or the like in a sheet of paper, by the time when the feed roller and the pressure roller have fed a sheet of paper to the position under the recording head. This improves the recording quality. The recorder is useful in particular as an ink jet printer or another apparatus of which the feed accuracy is liable to affect the recording quality.

BRIEF DESCRIPTION OF THE DRAWINGS

A preferred embodiment of the present invention is shown in the accompanying drawings, in which.

DETAILED DESCRIPTION OF THE EMBODIMENT

Figure 1:
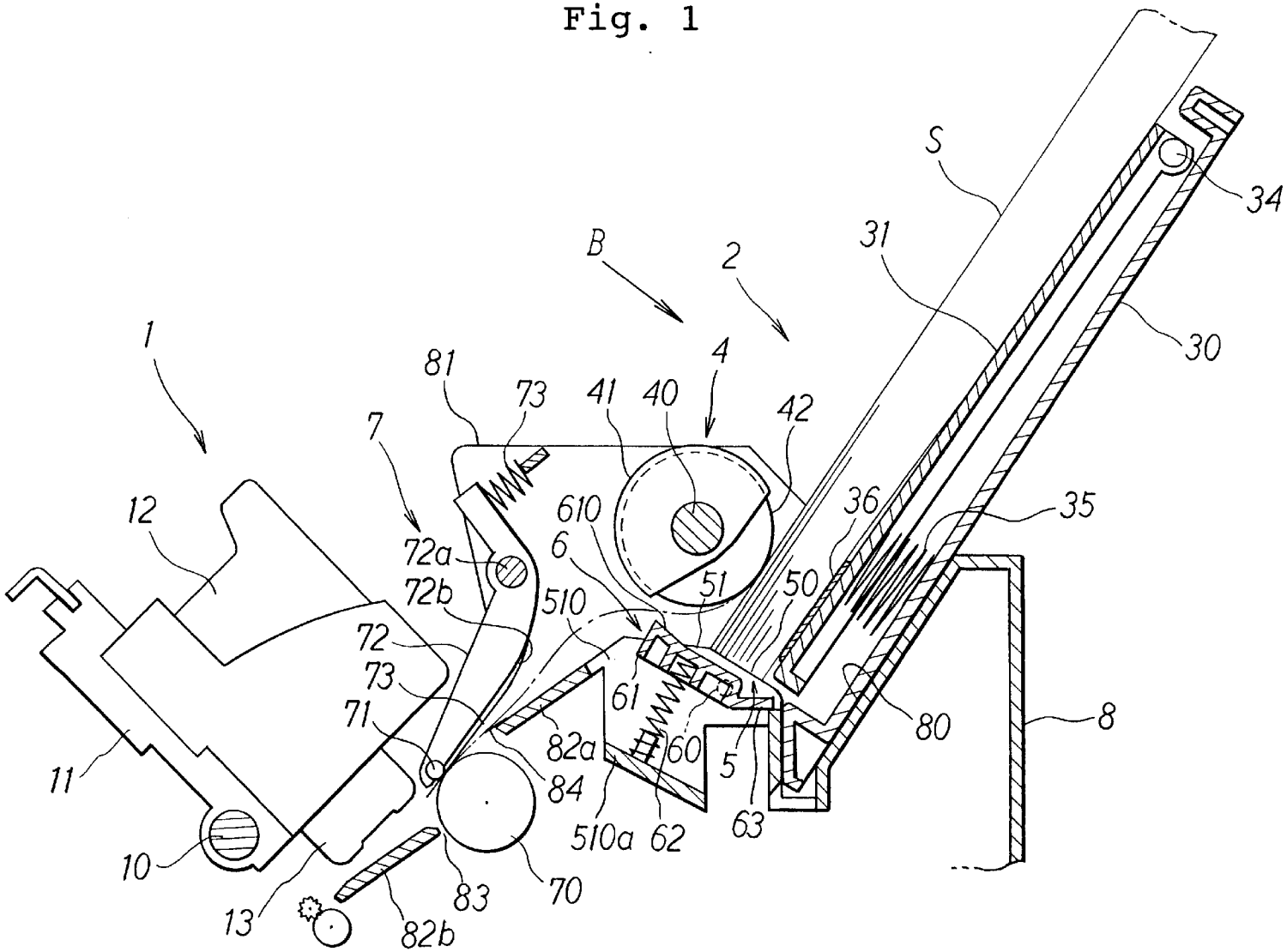
FIG. 1 is a partial cross section of an ink jet printer according to the embodiment.

With reference to FIG. 1, an ink jet printer includes a sheet feeder 2 for feeding sheets of paper S one by one to the front of a print unit 1 for printing the sheet fed by the feeder 2. The sheets S are rectangular cutforms of a certain size. The printer also includes a frame 8, on which a pair of side walls 81 stand.

The print unit 1 includes a carriage 11 supported slidably on a horizontal guide rail 10, which is fixed to the side walls 81. The rail 10 extends widthwise of the sheets S fed from the sheet feeder 2. In other words, the rail 10 extends in parallel with the surfaces of the sheets S and perpendicularly to the direction in which the sheets S are fed. The carriage 11 carries an ink cartridge 12 and a print head 13. While the carriage 11 is reciprocated horizontally by a drive (not shown), the head 13 can eject ink droplets onto a sheet of paper S positioned under it. This can print the sheet S with an image, which may include characters, graphics and/or figures, in the form of a dot matrix.

The feeder 2 includes a rectangular sheet hopper or cassette 30, in which sheets of paper S can be stacked. The sheets S in the hopper 30 can be sent one by one by a sheet sender 4. The feeder 2 also includes a wall 5, where a stop mechanism 6 is fitted. The front end of a sheet S sent from the hopper 3 comes into contact with the wall 5. A sheet conveyer 7 is positioned downstream from the wall 5 and upstream from the print unit 1.

The frame 8 includes a hopper support recess 80. The hopper 30 is supported by the recess 80 obliquely with its front side downward and its front and rear sides horizontal. Positioned in the hopper 30 is a sheet support 31, on which sheets of paper S can be stacked. The support 31 is supported at its rear end pivotably through a shaft 34 by the rear end of the hopper 30. The shaft 34 is parallel to the guide rail 10 of the print unit 1. The front end of the support 31 is urged toward the sender 4 by a spring 35.

Figure 2:
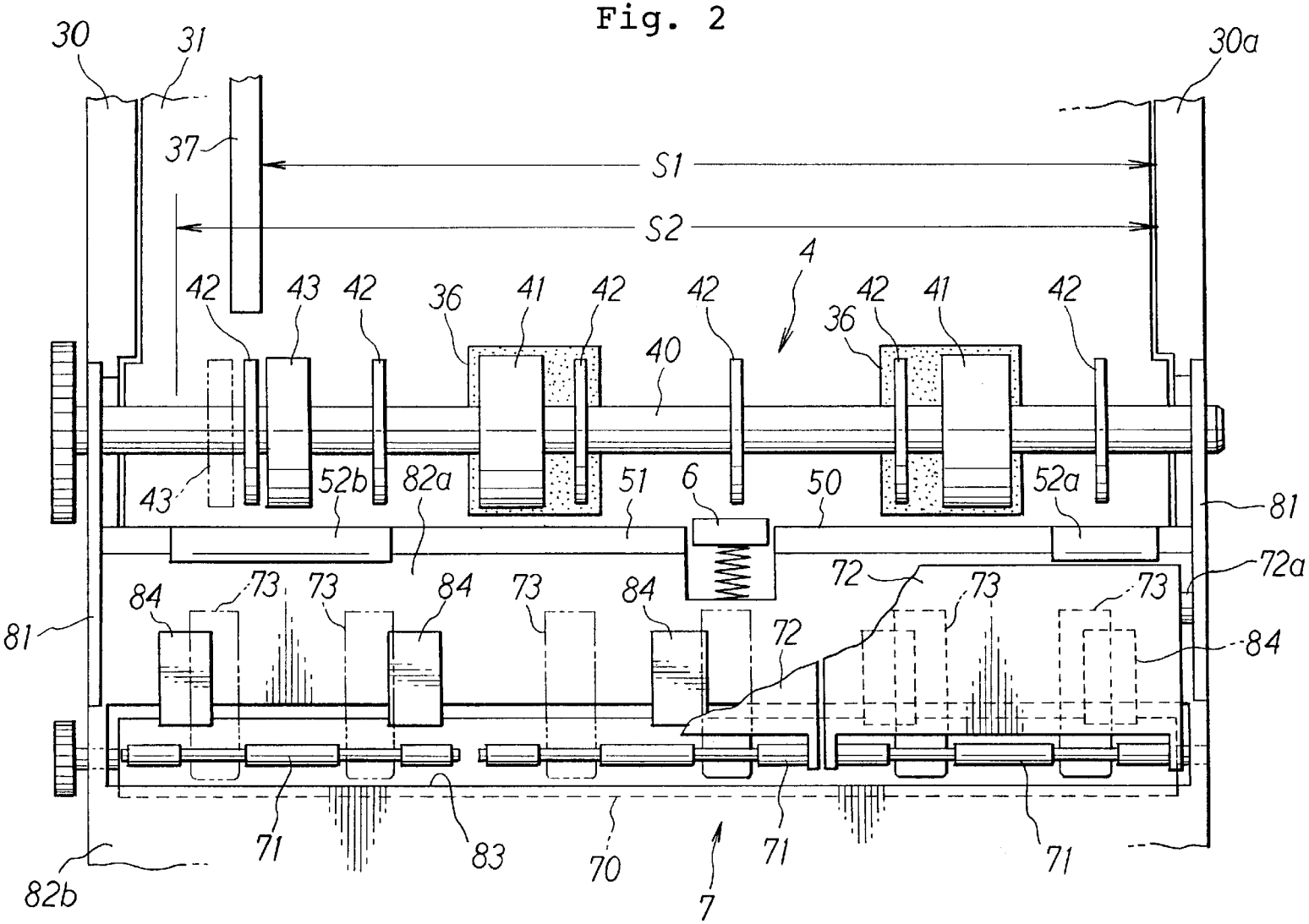
FIG. 2 is a partial view taken in the direction of arrow B of FIG. 1, but without sheets of paper.

As shown in FIGS. 1 and 2, the support 31 is fitted with friction members 36 on its upper surface. The friction members 36 can constrain onto the support 31 the bottom one of the sheets S stacked on the support 31. This prevents all of the sheets S from being sent one upon another from the support 31 when the number of sheets S is small (for example, two or three). The friction members 36 may be made of cork. The members 36 protrude from the upper surface of the support 31. Each member 36 is positioned under one of two main feed rollers 41, which will be described later. The members 36 might, however, be positioned between or near the rollers 41, or in other positions along the common axis of the rollers 41.

The hopper 30 includes a pair of side walls. The left (right in FIG. 2) side wall functions as a reference guide 30*a* for positioning and guiding the adjacent sides of the sheets S. The hopper 30 is fitted with a movable guide 37 on it for positioning the other sides of the sheets S in such a manner that the guide 37 can slide widthwise of the sheets S.

The sender 4 includes a shaft 40 supported at both its ends rotatably by the printer walls 81. The shaft 40 is parallel to the shaft 34. The shaft 40 can be rotated by a drive (not shown) clockwise in FIG. 1. The shaft 40 supports the main feed rollers 41, an auxiliary feed roller 43 and six collars or disks 42 coaxially at intervals.

Figure 7:
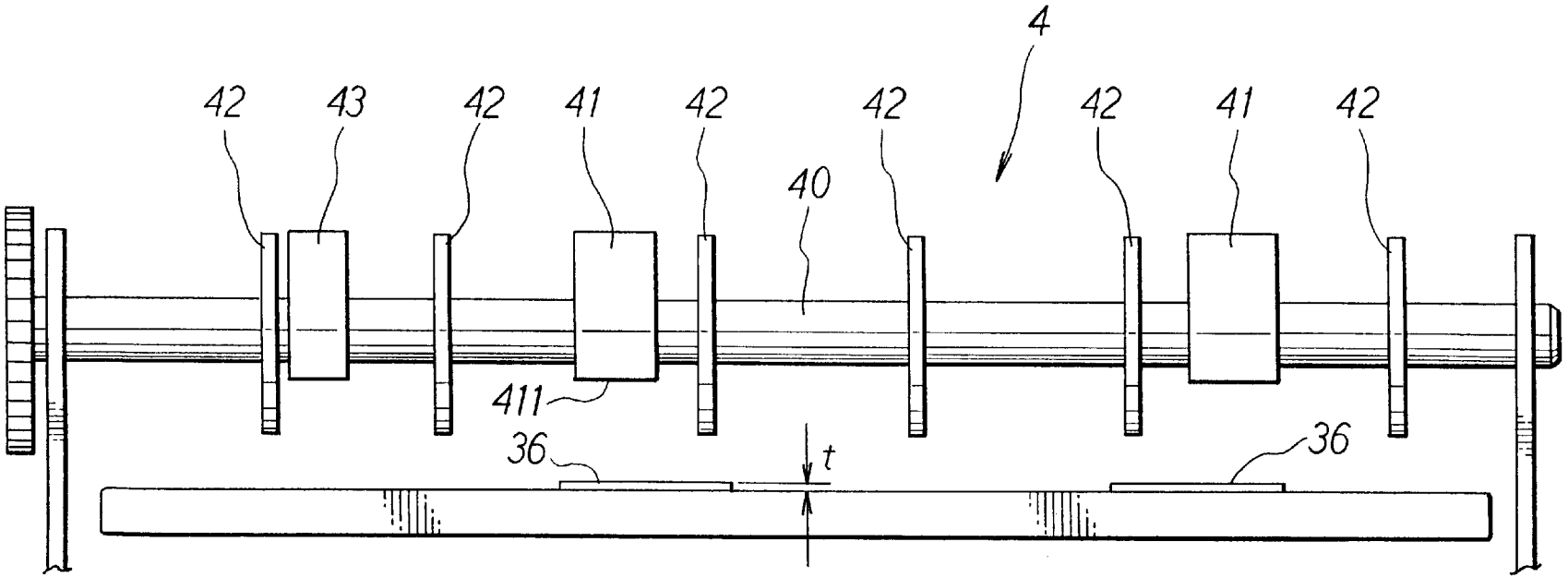
FIG. 7 is a partial front end view of the sheet feeder of the printer, showing the relationship between the sheet sender and sheet support.

The main feed rollers 41 are fixed to the shaft 40. The rollers 41 are semi-cylindrical and each have a cylindrical surface 410 (FIG. 4 etc.), which is coaxial with the shaft 40. As shown in FIG. 7, the leading and trailing ends of the surfaces 410 are aligned axially. Each surface 410 is circumferentially long enough to send a sheet of paper S to the lines of contact between the cylindrical feed roller 70 and the guide strips 73 of the conveyer 7.

The auxiliary feed roller 43 is fixed to the shaft 40, and has the same shape as the main feed rollers 41 have, but is smaller axially than them.

Figure 4:
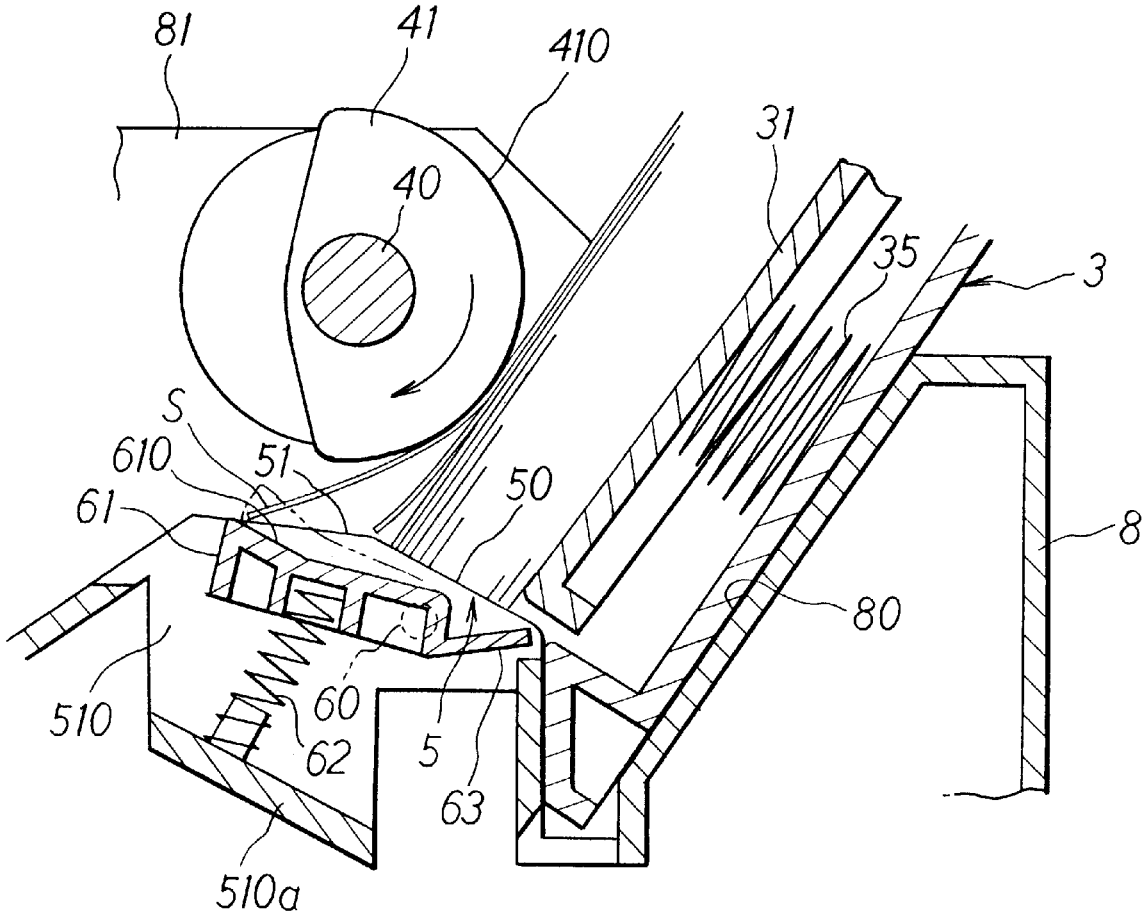
FIG. 4 is another enlarged partial cross section of the printer, showing a sheet of higher rigidity being separated.

The collars 42 each have an outer peripheral surface of constant curvature, and can rotate relatively to the shaft 40. As shown in FIG. 4 etc., the peripheral surfaces of the collars 42 are smaller slightly in diameter than the cylindrical surfaces of the semi-cylindrical feed rollers 42 and 43. The collars 41 are positioned at predetermined intervals over the width of the support 31.

With reference to FIG. 1, sheets of paper S of a standard size may be stacked on the support 31. When the semi-cylindrical feed rollers 41 turn with the shaft 40 clockwise in FIG. 1 from their initial position shown in FIG. 1, their cylindrical surfaces 410 come into compressive contact with the top one of the sheets S. Further turning of the rollers 41 sends part of the top sheet S out of the hopper 30. When the cylindrical surfaces 410 have turned away from the hopper 30, the partially sent sheet S comes into contact with the peripheral surfaces of the collars 42. Consequently, the rollers 41 are kept spaced from the sheets S. In the meantime, the conveyer 7 conveys the partially sent sheet S. The collars 42 turn by following the sheet being conveyed. Until the next sheet S starts to be sent, the sheets S remaining in the hopper 30 are kept from floating or swelling by virtue of the collars.

As shown in FIG. 2, the main feed rollers 41 are positioned at an interval to apply sending force in lateral balance to sheets of paper of the standard sizes for business when the sheets are stacked on the support 31. For the stacked sheets of the A4 or English letter size S1, each roller 41 is located at a predetermined distance inward from the adjacent lateral ends of the sheets. For the stacked sheets of the B5 size and a post card placed on the support 31, the rollers 41 are spaced from each other in such a manner that both of them are in contact with the top one of the sheets or the card.

The auxiliary feed roller 43 is positioned between the lateral end of the support 31 which is opposite to the reference guide 30*a* and the farther main roller 41 from the guide 30*a*. The auxiliary roller 43 is spaced from the adjacent main roller 41. When an envelope of the size S2 (FIG. 2) for sheets of the size S1 is placed on the support 31, the auxiliary roller 43 is located at a predetermined distance inward from the lateral end of the envelope which is away from the reference guide 30*a*. This roller 43 is aligned nearly with the lateral ends of the sheets of the size S1 which are away from the guide 30*a*.

In accordance with the size, the rigidity and/or the like of envelopes, the auxiliary feed roller 43 may be larger axially, or another auxiliary feed roller 43 might be added as shown by two-dot chain lines in FIG. 2. The support 31 is fitted with no friction member/s (36) under the roller/s 43.

Figure 3:
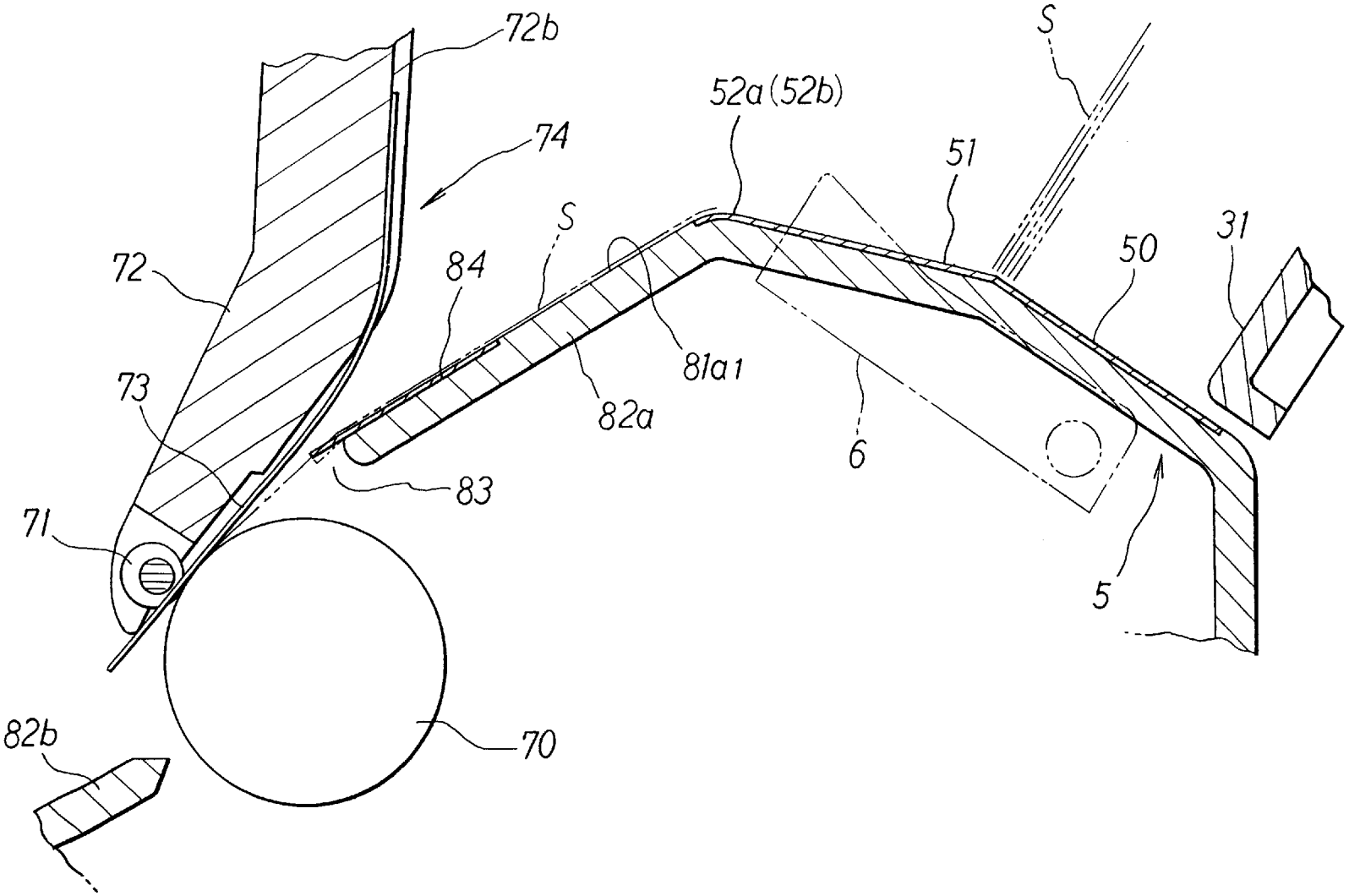
FIG. 3 is an enlarged partial cross section of the printer.

As shown in FIG. 1, the wall 5 of the feeder 2 is positioned at the front end of the hopper support recess 80, and integral with the frame 8. As shown in FIG. 3, the wall 5 has a stop surface 50 for stopping or bearing the front ends of the sheets S. The wall 5 also has an inclined surface 51 extending from the front end of the stop surface 50. The inclined surface 51 gradually rises away from the hopper 30. The frame 8 includes a passage wall 82*a* extending from the front end of the inclined surface 51. The frame 8 includes another passage wall 82*b* extending from the front end of the wall 82*a*. Formed along the walls 5, 82*a* and 82*b* is a sheet passage for the sheets S sent from the hopper 30. The passage extends to a position over which the head 13 can reciprocate.

Figure 6:
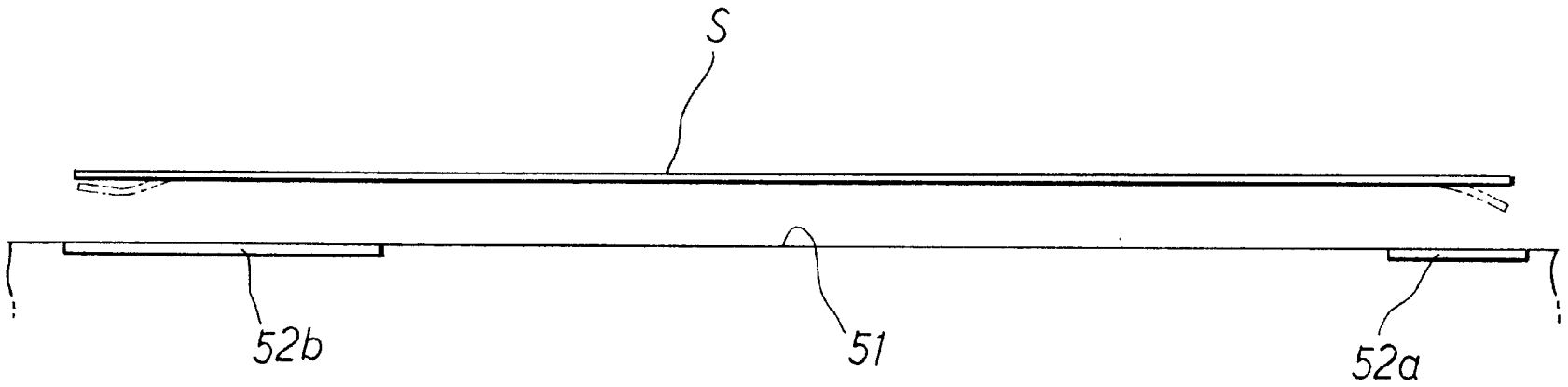
FIG. 6 is a fragmentary front view of the printer, showing the relationship between a sheet of paper and the inclined surface (51) of the printer.

As shown in FIGS. 2 and 3, the wall 5 is fitted with a pair of resin sheets 52*a* and 52*b* near its left and right edges, respectively. These sheets 52*a* and 52*b* each extend over the stop surface 50 and the inclined surface 51, and are stuck to them. The surfaces of the sheets 52*a* and 52*b* are smooth and low in resistance. The friction factors of the resin sheets 52*a* and 52*b* with respect to the paper sheets S are smaller sufficiently than that of the other area of the inclined surface 51. The resin sheet 52*a* is positioned at the edges of the paper sheets S which are adjacent to the reference guide 30*a*. The other sheet 52*b* faces the auxiliary feed roller/s 43. In other words, the resin sheet 52*b* is positioned on the opposite side of the right (left in FIG. 2) main feed roller 41 to the reference guide 30*a*. This sheet 52*b* is wider than the sheet 52*a*. The auxiliary feed roller 43 can move a right end portion of an envelope of the size S2. While this portion is sliding up the inclined surface 51, the resistance to it is reduced by the resin sheet 52*b*. An envelope is made of a folded or doubled thick sheet of paper, and somewhat rigid. If, as shown in FIG. 6, one or both of the right and left ends of a somewhat rigid envelope are bent or warped down, they are in strong or close contact with the inclined surface 51 and resisted highly while sliding on it. The resin sheets 52*a* and 52*b* reduce the resistance.

The inclined surface 51 has a recess 510 opening upon the sheet passage. The stop mechanism 6 is fitted in the recess 510. The surface 51 might be curved. As shown in FIG. 2, the stop mechanism 6 is positioned in lateral symmetry with respect to the main feed rollers 41. In other words, the stop mechanism 6 is positioned midway between the rollers 41. In place of the single stop mechanism 6, two or more stop mechanisms might be fitted in laterally symmetric positions between the rollers 41. The stop mechanism 6 can apply a load symmetrically on the sending forces of the rollers 41.

The stop mechanism 6 includes a stopper 61 supported pivotably on a pin 60. The stopper 61 is urged by a coil spring 62 so that the top surface 610 of its front end portion normally protrudes from the inclined surface 51 toward the hopper 30. The pin 60 is parallel to the shaft 40, and positioned upstream from the inclined surface 51. Normally, the stopper surface 610 faces the hopper 30 and, as viewed from the hopper 30, inclines at an obtuse angle to the inclined surface 51 so that it can contact a paper sheet S sent from the hopper 30. With respect to the direction in which paper sheets S are sent, the stopper surface 610 is larger in gradient or inclination than the inclined surface 51. The stopper 61 includes a tail 63 extending from its rear end. The tail 63 can contact the top of the rear wall of the recess 510 so as to stop the stopper 61 from protruding further from the inclined surface 51.

The stopper 61 is made of resin similar to the resin of which the frame 8 is made. The rigidity of the stopper 61 is high enough to keep the stopper shape constant against the force with which a paper sheet S pushes the stopper surface 610. The force with which the spring 62 urges the stopper 61 is so set that the stopper 61 protrudes from and retracts under the inclined surface 51 in accordance with the rigidity of paper sheets S. This ensures proper separation effect in accordance with the rigidity of paper sheets S.

When the stopper surface 610 is pressed by a post card, an envelope, a thick paper sheet or another paper sheet S of somewhat high rigidity, as shown with solid lines in FIG. 4, the stopper 61 is retracted from the sheet passage to a position where the front end of its surface 610 is nearly on the inclined surface 51. Consequently, the sheet S can be sent from the hopper 30 with its front end sliding on the inclined surface 51. Even if a plurality of somewhat rigid sheets S are sent at the same time from the hopper 30, their front end portions are separated from each other by curving along the inclined surface 51. As a result, only the top sheet S is moved by the main feed rollers 41 so as to pass the inclined surface 51.

When a large number of envelopes are stacked on the support 31, the semi-cylindrical feed rollers 41 and 43 can apply frictional force over the whole width of the top sheet, in spite of the height (thickness "t" in FIG. 7) of the friction members 36 from the support 31, due to the flexibility of the sheets. The sheet can therefore be sent without inclining sideways. As shown in FIG. 6, end portions of an envelope may be bent, curved or warped, and consequently their rigidity may be high. Even in this case, the envelope can pass the inclined surface 51 without being resisted highly because of the small friction factor of the resin sheets 52*a* and 52*b*, on which the envelope end portions slide.

When the number of envelopes stacked on the support 31 is small, the pressures with which the support 31 presses the envelopes against each main feed roller 41 and the auxiliary feed roller 43 differ from each other due to the thickness "t" of the friction members 36 (FIG. 7). Consequently, the sending force of the auxiliary feed roller 43 is smaller than that of each main feed roller 41. Accordingly, the envelopes can be sent mainly by the main feed rollers 41. The sending force of the auxiliary feed roller 43 acts on the end portion of an envelope outside the right (left in FIG. 7) main feed roller 41 is small. Even though this force is small, the envelope can pass the inclined surface 51 without inclining sideways because the low friction resin sheet 52*b* extends in the portion of the inclined surface 51 on which the envelope end portion slides.

Figure 5A:
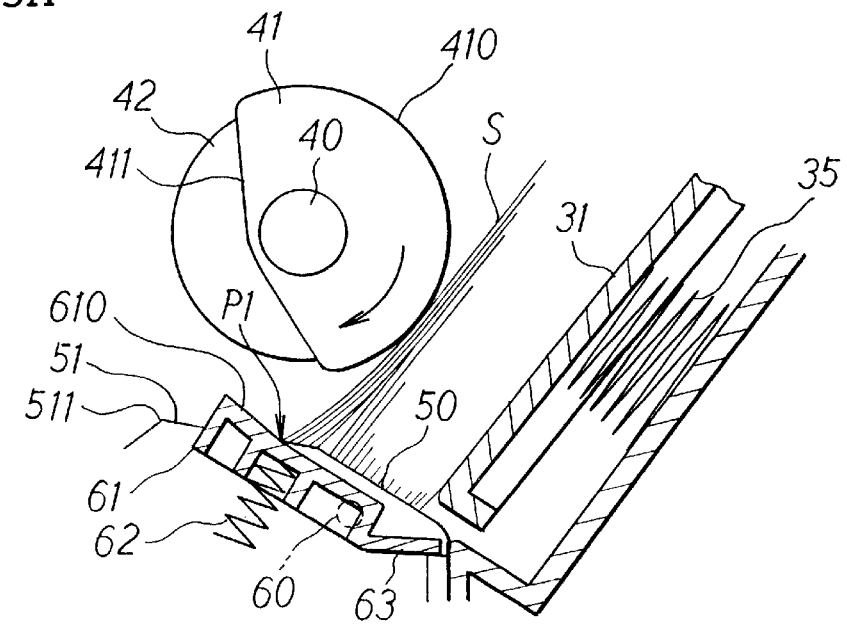
FIGS. 5A, 5B and 5C are other enlarged partial cross sections of the printer, each showing a sheet of lower rigidity being separated.
Figure 5B:
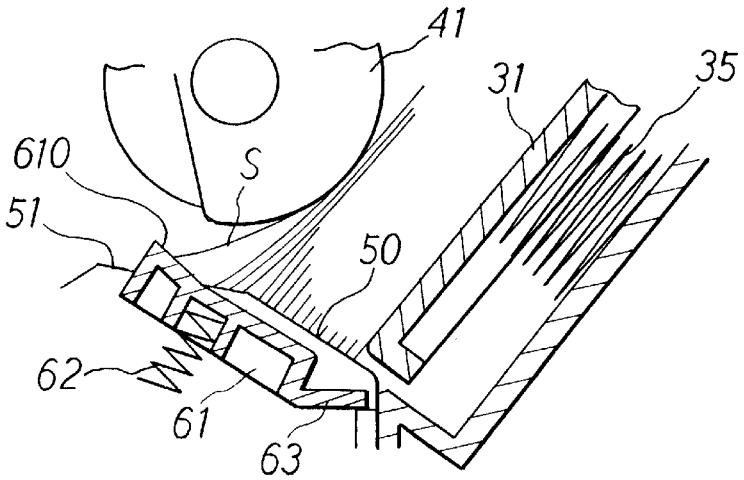
Figure 5C:
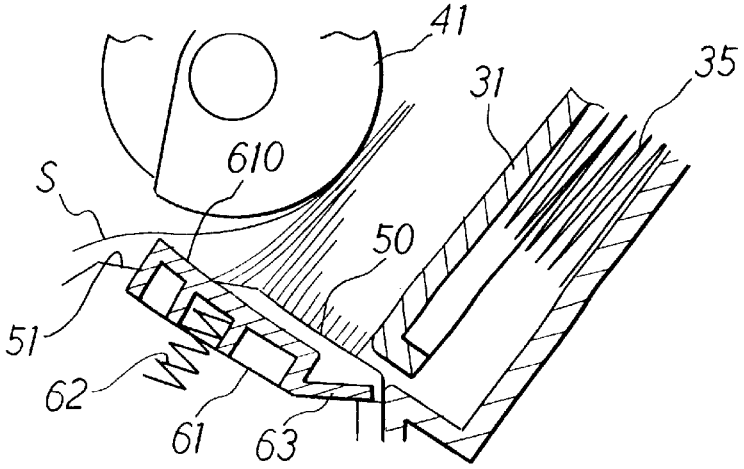

When a thin sheet of paper for business or another paper sheet S of low rigidity is forced onto the stopper 61, as shown in FIG. 5A, its rigidity is so low as to hardly compress the spring 62. Accordingly, the stopper surface 610 protrudes from the inclined surface 51. As shown in FIGS. 5B and 5C, the forced sheet S curves, passes the stopper 61 and is sent. In this case, a front end portion of the sheet S curves more than when the stopper 61 is retracted under the inclined surface 51. Consequently, even the sheet S of low rigidity is separated fully from the sheets remaining in the hopper 30, while the remaining sheets are constrained securely by the stopper 61.

Thus paper sheets S of low rigidity can be separated exclusively by the stopper 61. Therefore the inclination of the inclined surface 51 can be so set as to properly separate paper sheets S of high rigidity. This can securely separate various paper sheets independently of their rigidity.

As stated already, the auxiliary feed roller 43 as well as the main feed rollers 41 act to send paper sheets of the A4 size S1. Only the main feed rollers 41 send paper sheets of smaller sizes such as B5. In this case, when the number of paper sheets stacked on the support 31 is small, the auxiliary feed roller 43 idles while the main feed rollers 41 send the sheets because of no friction member (36) under the roller 43. If a friction member (36) was provided additionally under the roller 43, this roller would interfere with the friction member when the number of paper sheets stacked on the support 31 is small. This would hinder the turning of the main feed rollers 41. In accordance with this embodiment of the invention, as stated already, the sheets can be sent without hindrance.

As shown in FIGS. 1 and 2, the conveyer 7 includes the cylindrical feed roller 70, nine pressure rollers 71 and three holders 72, each of which supports three of the rollers 71. The holders 72 are supported pivotably by a shaft 72*a*, which extends in parallel to the shaft 40 between the side walls 81. The conveyer 7 also includes the passage wall 82*a*. Formed between the passage walls 82*a* and 82*b* is a slot or opening 83, through which the cylindrical surface of the feed roller 70 is exposed partially to the sheet passage. Each holder 72 is urged by a spring 73 in such a manner that the pressure rollers 71 are in compressive contact with the exposed surface of the feed roller 70. The axes of the rollers 70 and 71 are parallel to the shaft 40.

The downstream passage wall 82*b* faces the print head 13, and inclines relative to the ejection surface of the head 13.

The tangent on the line of contact between the cylindrical feed roller 70 and each pressure roller 71 inclines so as to intersect the downstream passage wall 82*b*. A paper sheet fed by the rollers 70 and 71 comes into contact with the wall 82*b* obliquely from above.

The holder shaft 72*a* is positioned upstream from the pressure rollers 71. Each holder 72 has a surface 72*b* upstream from the pressure rollers 71. The upstream surfaces 72*b* of the holders 72 and the upstream passage wall 82*a* define part of the sheet passage. In other words, the holders 72 function as passage walls opposite the wall 82*a*. Each holder 72 is fitted with two first elastic guide strips 73, which may be made of sheet metal or resin film.

The rear end of each strip 73 is fixed to the upstream surface 72*b* of the holder 72. The six strips 73 on the holders 72 are positioned at intervals along the axis of the cylindrical feed roller 70. A free end portion of each strip 73 is in contact with the feed roller 70, and extends under the shaft connecting the pressure rollers 71 together. The free end of each strip 73 protrudes toward the print head 13. The upstream surfaces 72*b* of the holders 72 and the strips 73 constitute guide surfaces 74 for guiding a paper sheet to the lines of contact between the rollers 70 and 71.

Figure 8:
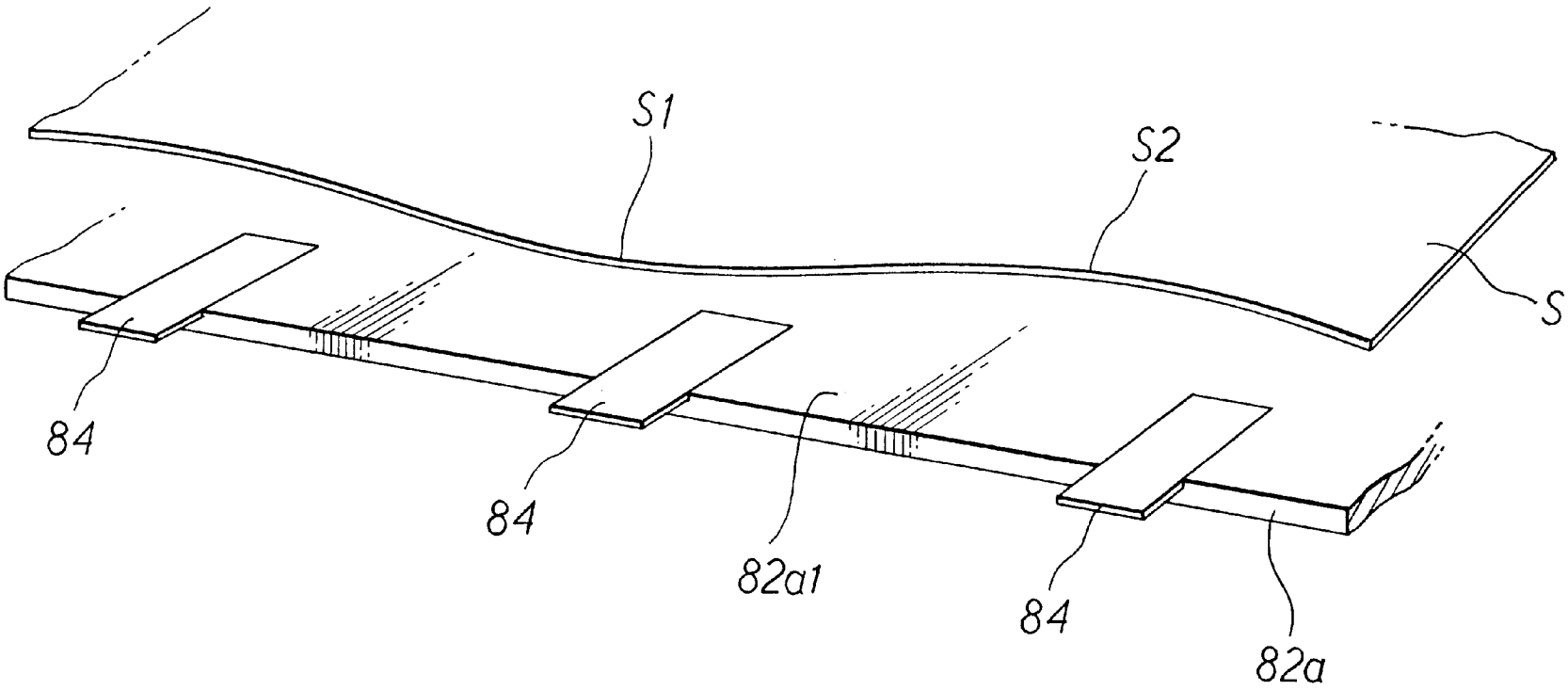
FIG. 8 is a fragmentary perspective view of the printer, showing the relationship between a sheet of paper and the second guide strips of the printer.

The upper surface 82*a*1 (FIG. 8) of the upstream passage wall 82*a* extends at an acute angle with the guide surfaces 74 of the holders 72 as viewed from the upstream side. The passage surface 82*a*1 and each guide surface 74 narrow a part of the sheet passage gradually toward the cylindrical feed roller 70. The upstream passage wall 82*a* is fitted with second elastic guide strips 84, which may be made of sheet metal or resin film. The rear ends of the strips 84 are fixed to the front end of the passage surface 82*a*1. As shown in FIGS. 2 and 8, these strips 84 are positioned at intervals along the axis of the cylindrical feed roller 70. The free ends of the strips 84 protrude toward the guide surfaces 74 of the holders 72, and can elastically deform perpendicularly to the passage surface 82*a*1 as shown in FIG. 3.

The front end of a sheet S sent from the hopper 30 by the main feed rollers 41 may move along the inclined surface 51 and passage surface 82*a*1, and come into contact with the guide surfaces 74 of the holders 72. Otherwise, the sheet end may move over the passage surface 82*a*1, and come into contact with upper portions of the guide surfaces 74. As shown in FIG. 8, it is not avoidable that the sheet end is wavy up and down over the width of the sheet. The sheet wave has one or more valleys S1 and one or more peaks S2. When the sheet end has come near the nips defined between the cylindrical feed roller 70 and the guide surfaces 74, the valleys S1 and peaks S2 meet the roller 70 at different angles. The valleys S1 meet the cylindrical surface of the roller 70 at larger angles than the peaks S2. The deeper the valleys S1 are, the nearer to a right angle the angles at which they meet the roller surface are.

Without the second guide strips 84, the sheet S might be damaged by the shock caused when the wave valleys S1 meet the feed roller 70. In particular, the damage is serious if the valleys S1 meet the roller 70 turning reversely as stated below.

The second guide strips 84 and the guide surfaces 74 of the holders 72 define part of the sheet passage, which narrows downstream. Accordingly, the wavy sheet S moves downstream along the guide surfaces 74 while it is flattened substantially, and reaches the nips between the cylindrical feed roller 70 and first guide strips 73. When the sheet S has just reached the nips, the roller 70 is either turning reversely (clockwise in FIG. 1) or stopping. Therefore, the sheet S is not conveyed toward the print head 13. In the meantime, the main feed rollers 41 keep turning by a predetermined angle. As a result, the sheet S curves on or over the passage wall

82*a*. The front end or edge of the curved sheet S is positioned on the nips, and its inclination is rectified. Thus, the sheet S is registered.

Thereafter, the cylindrical feed roller 70 is turned normally (counter-clockwise in FIG. 1) to feed the sheet S between it and the pressure rollers 71 until the first printing position on the sheet is under the head 13. In the meantime, the main feed rollers 41 keep turning until they return to their initial position shown in FIG. 1, where their cylindrical surfaces 410 are away from the sheets S. The rollers 41 then stop at the initial position.

Each time the print unit 1 has printed a line on a sheet S, the cylindrical feed roller 70 feeds the sheet by a predetermined amount, drawing a rear part of the sheet from the hopper 30. In the meantime, the collars 42 are in compressive contact with the sheet S. Therefore, while the collars 42 keep the main feed rollers 41 spaced from the sheet S, the collars turn by following the sheet being drawn. Because the sheet S is urged against the collars 42 by the spring 35, the collars 42 turn with friction on the shaft 40. Accordingly, the cylindrical feed roller 70 draws the sheet S with predetermined resistance. This keeps the sheet S tense along the passage surface 82*a*1 between the roller 70 and collars 42.

When the cylindrical feed roller 70 draws a sheet S, the free ends of the second guide strips 84 curve toward this roller. The sheet S being drawn curves gently along the passage surface 82*a*1 and the strips 84, and turns at an obtuse angle toward the roller 70.

The wave of a sheet S could be rectified by the front end of the passage wall 82*a* extending to a position as close as possible to the guide surfaces 74. When the sheet S is tense, however, it would turn at the extended end of the wall 82*a* so sharply that the feeding is resisted. In particular, an envelope, a post card or another paper sheet of higher rigidity does not easily bend, and would therefore be resisted higher.

Therefore, the front end of the passage wall 82*a* is spaced as away as possible from the lines of contact between the cylindrical feed roller 70 and first guide strips 73. As stated above, the free ends of the second guide strips 84 can be curved down by virtue of the elasticity of the second guide strips 84 (FIG. 3). This prevents a sheet S from turning or bending sharply at the front end of the wall 82*a*, and can consequently reduce the resistance.

A sheet feeder according to the invention can be applied to, not only ink jet printers, but also laser printers, copying machines, facsimile machines and other printers. The invention may be applied to even sheet feeders where sheets of paper are held horizontally.

In the embodiment, the elastic guide strips 84 are connected to the front end of the first passage wall 82*a*, but the invention is not limited to this structure. In place of the strips 84, at least the front end portion of the wall 82*a* might be elastically deformable. A composite material or component can be used for the strips 84. For example, the wall 82*a* might include a front end portion made of rubber or other elastic material and a main portion made of resin, metal or other rigid material. Otherwise, the first passage wall (first guide) itself might be made of elastic material.

What is claimed is:

1. A sheet conveyor comprising:

a feed roller;

a pressure roller in compressive contact with the feed roller for cooperating with the feed roller to feed a sheet of paper between the feed roller and the pressure roller; and guides including a first guide and a second guide;

the guides defining a traveling passage therebetween for a sheet of paper to be sent to a nip between the feed roller and the pressure roller;

the guides being positioned in such a manner that the passage narrows toward the nip;

at least a front end portion of the second guide being made of material which can elastically deform toward the nip, wherein the first and second guides guide the upper and lower sides, respectively, of a sheet of paper being sent to the nip; and wherein the first and second guides and the nip are positioned relative to each other in such a manner that a production from the second guide intersects the first guide on the upstream side of the nip.

2. A sheet conveyer according to claim 1, wherein the second guide is a solid member, and includes an elastic member mounted on the front end thereof.

3. A sheet conveyer according to claim 2, wherein the elastic member extends near to the nip so as to guide the front end of a sheet of paper to the nip, a front end portion of the elastic member deforming toward the nip in accordance with the tension of a sheet of paper after the sheet reaches the nip.

4. A sheet conveyer according to claim 1, wherein the second guide is positioned relative to the nip in such a manner that the plane between the front end of the second guide and the nip extends at an obtuse angle with the guide surface of the second guide.

5. A sheet conveyer according to claim 1, wherein the first guide is an elastic member, and is in contact with the feed roller on the upstream side of the nip.

6. A sheet conveyer according to claim 5, wherein the pressure roller is defined by a plurality of pressure rollers being arranged at intervals along the axis of the feed roller, and the first guide is defined by a plurality of first guides each extending between adjacent two of the pressure rollers from the upstream side of nips between the feed roller and the plurality of the pressure rollers to the downstream side of the nips.

7. A sheet conveyer according to claim 6, wherein nips between the feed roller and the plurality of first guides register a sheet of paper.

8. A sheet conveyer according to claim 1, further comprising a holder, which supports the pressure roller rotatably, the holder being shaped to guide a sheet of paper to the nip, the first guide and the holder cooperating to guide the upper side of a sheet of paper.

9. A recorder comprising:

a feed roller;

a pressure roller in compressive contact with the feed roller for cooperating with the feed roller to feed a sheet of paper between the feed roller and the pressure roller; and guides including a first guide and a second guide;

the guides defining a traveling passage therebetween for a sheet of paper to be sent to a nip between the feed roller and the pressure roller;

the guides being positioned in such a manner that the passage narrows toward the nip;

at least a front end portion of the second guide being made of material which can elastically deform toward the nip; and a recording head positioned downstream from the nip, wherein the first and second guides guide the upper and lower sides, respectively, of a sheet of paper being sent to the nip; and wherein the first and second guides and the nip are positioned relative to each other in such a manner that a production from the second guide intersects the first guide on the upstream side of the nip.

10. A recorder according to claim 9, wherein the second guide is a solid member, and includes an elastic member mounted on the front end thereof.

11. A recorder according to claim 10, wherein the elastic member extends near to the nip so as to guide the front end of a sheet of paper to the nip, a front end portion of the elastic member deforming toward the nip in accordance with the tension of a sheet of paper after the sheet reaches the nip.

12. A recorder according to claim 9, wherein the second guide is positioned relative to the nip in such a manner that the plane between the front end of the second guide and the nip extends at an obtuse angle with the guide surface of the second guide.

13. A recorder according to claim 9, wherein the first guide is an elastic member, and is in contact with the feed roller on the upstream side of the nip.

14. A recorder according to claim 13, wherein the pressure roller is defined by a plurality of pressure rollers being arranged at intervals along the axis of the feed roller, and the first guide is defined by a plurality of first guides each extending between adjacent two of the pressure rollers from the upstream side of nips between the feed roller and the plurality of the pressure rollers to the downstream side of the nips.

15. A recorder according to claim 14, wherein nips between the feed roller and the plurality of first guides register a sheet of paper.

16. A recorder according to claim 9, and further comprising a holder, which supports the pressure roller rotatably, the holder being shaped to guide a sheet of paper to the nip, the first guide and the holder cooperating to guide the upper side of a sheet of paper.

17. A recorder according to claim 9, which is an ink jet printer.

* * * * *